US006094915A

United States Patent [19]

Negre et al.

[11] Patent Number: 6,094,915

[45] Date of Patent: Aug. 1, 2000

[54] METHOD AND DEVICES FOR ELIMINATING THE POLLUTION OF CYCLIC INTERNAL COMBUSTION ENGINES WITH AN INDEPENDENT COMBUSTION CHAMBER

[76] Inventors: Guy Negre; Cyril Negre, both of 3405 - 4ème avenue B.P. 547, F-06516 Carros Cedex, France

[21] Appl. No.: 08/913,057

[22] PCT Filed: Mar. 4, 1996

[86] PCT No.: PCT/FR96/00335

§ 371 Date: Sep. 5, 1997

§ 102(e) Date: Sep. 5, 1997

[87] PCT Pub. No.: WO96/27737

PCT Pub. Date: Sep. 12, 1996

[30] Foreign Application Priority Data

Mar. 6, 1995 [FR] France ..... 95 02838

[51] Int. Cl.[7] ..... F07B 75/02; F02G 3/02

[52] U.S. Cl. ..... 60/712; 60/39.6; 123/22

[58] Field of Search ..... 60/39.6, 712; 123/22

[56] References Cited

U.S. PATENT DOCUMENTS

| | | | |
|---|---|---|---|
| 778,289 | 12/1904 | Wallman | 123/22 |
| 1,013,528 | 1/1912 | Broderick | 60/712 |
| 1,849,324 | 3/1932 | Goldsborough | 60/712 |
| 3,839,858 | 10/1974 | Avermaete | 60/712 |
| 4,211,083 | 7/1980 | Ueno . | |
| 4,433,549 | 2/1984 | Zappia | 123/22 |
| 4,817,388 | 4/1989 | Bland | 60/712 |
| 5,638,681 | 6/1997 | Rapp | 60/712 |

FOREIGN PATENT DOCUMENTS

| | | |
|---|---|---|
| 728 686 | 7/1932 | France . |
| 2 416 344 | 8/1979 | France . |

*Primary Examiner*—Michael Koczo
*Attorney, Agent, or Firm*—Young & Thompson

[57] ABSTRACT

A pollution control method and related devices for cyclical internal combustion engines having a separate combustion chamber (1), wherein the compression chamber, the combustion chamber (1) and the expansion chamber (16) consist of three separate and entirely self-contained portions. During low-power operation, e.g. in urban traffic, the fuel injector (6) is no longer controlled during filling of the combustion chamber, whereby the combustion chamber is filled with high-temperature pure compressed air at each cycle. A small amount of additional air from an outer tank (23) for storing highly pressurized air at room temperature is fed into the combustion chamber substantially after the intake of compressed air from the engine compressor, and heated as it contacts the hot compressed air already present in the combustion chamber (1), whereafter it expands and increases the starting pressure to enable effective work to be produced during expansion.

5 Claims, 3 Drawing Sheets

METHOD AND DEVICES FOR ELIMINATING THE POLLUTION OF CYCLIC INTERNAL COMBUSTION ENGINES WITH AN INDEPENDENT COMBUSTION CHAMBER

CROSS REFERENCE TO RELATED APPLICATIONS

This application is the 35 USC 371 national stage of PCT/FR96/00335 filed on Mar. 4, 1996, which designated the United States of America.

FIELD OF THE INVENTION

The invention relates to a method and to devices for reducing the pollution of cyclic internal combustion engines with constant-volume independent combustion chambers.

BACKGROUND OF THE INVENTION

In his French patent applications with national registration numbers 9501518 and 9502212, the author has described a cyclic internal combustion engine method, the engine having a constant-volume independent combustion chamber, in which the compression chamber, the combustion chamber and the expansion chamber consist of three separate and entirely independent parts, thus allowing each of the three elements to be adapted to suit the function assigned to it without interfering with one another, as well as a system for controlling expansion (9502212) that makes it possible to make the maximum expansion pressure coincide with a crank angle that gives a high tangential force, further improving the overall efficiency of this type of engine.

However, when running in urban areas, especially with cars, the engine still consumes fuel which means that there are still polluting emissions even though these are very substantially reduced.

SUMMARY OF THE INVENTION

The method according to the invention makes it possible to eliminate entirely these emissions of polluting gases, especially in town driving when the engine requires little power.

It is characterized by the implementation means, and more particularly by the fact that during running at low power, the fuel injector is no longer operated and that in this case, any appropriate means are used to introduce into the combustion chamber substantially after the compressed air (without fuel) from the engine compressor has been let into this chamber—a small amount of additional air from an external reservoir in which air (or any other gas) is stored at very high pressure; this small amount of compressed air at ambient temperature will heat up when it comes into contact with the mass of hot air contained in the combustion chamber, will expand and will substantially increase the pressure that there is in the combustion chamber, so that as it expands it will be able to produce a power stroke sufficient to allow, for example, a vehicle to run in town driving mode. The amount of power produced will depend on the amount of additional air injected.

It is also characterized by the fact that the engine is equipped with a high-pressure compressor, which will be engaged during slowing down or during running at high power, in order to allow the external reservoir to be replenished with compressed air at very high pressure, thus making it possible to improve the range in eliminated-pollution running.

Thus the present invention relates to a method for eliminating the pollution of a cyclic internal combustion engine with a constant-volume independent combustion chamber, in which the compression chamber, the combustion chamber and the expansion chamber consist of three separate and entirely independent parts. This allows each of the three elements to be adapted to suit the function assigned to it without interfering with one another, where combustion takes place in an isolated constant-volume independent chamber which may also be equipped with a system for controlling the expansion making it possible to improve the efficiency of the engine. The method is characterized in that during running at low power, for example urban driving, for a vehicle thus equipped:

- the fuel injector is no longer operated during the filling of the constant-volume combustion chamber and the latter is therefore filled with compressed pure air at high temperature during each cycle;
- any appropriate means are used to introduce into the combustion chamber—substantially after the compressed air from the engine compressor has been let in—a small amount of additional air (or any other gas) from an external reservoir in which air (or such other gas) is stored at a very high pressure, at ambient temperature, and allowed to expand to a pressure slightly higher than the pressure in the combustion chamber in order to allow it to be transferred thereto;
- this small amount of additional air will heat up when it comes into contact with the hot compressed air already contained in the combustion chamber, will expand and will substantially increase the initial pressure that there is in the combustion chamber, so that as it expands it will be able to produce an adequate power stroke.

The engine is fitted with an auxiliary high-pressure compressor which will be switched on as the vehicle slows down or brakes, as well as during running at high power when the fuel injector is operated, thus making it possible to improve the range in eliminated-pollution running.

It will now be possible to understand the operation of the engine according to the invention which will thus be able to run at low power, in urban areas, without emitting polluting gases and will be capable instantaneously, on demand, of producing power compatible with normal use on the highway by operating the fuel injector and ceasing to operate the additional-air injector.

The amount of additional air injected, the injection means, the method of storing the compressed air, the gas used, the means of filling the storage reservoir—by on-board compressor operating during deceleration and braking or when running along the highway, and/or from a pump in specially equipped service stations or alternatively by replacing the storage bottle—can vary without in any way altering the principle of the invention.

The invention is quite particularly applicable to cyclic internal combustion engines with a constant-volume independent combustion chamber, especially for urban use in vehicles as well as for any other engine application. It also applies to conventional internal combustion engines.

BRIEF DESCRIPTION OF THE DRAWINGS

Other objects, advantages and features of the invention will become clear from reading the nonlimiting description of several embodiments given with respect to the appended drawings in which.

DETAILED DESCRIPTION OF THE INVENTION

Figure 1:
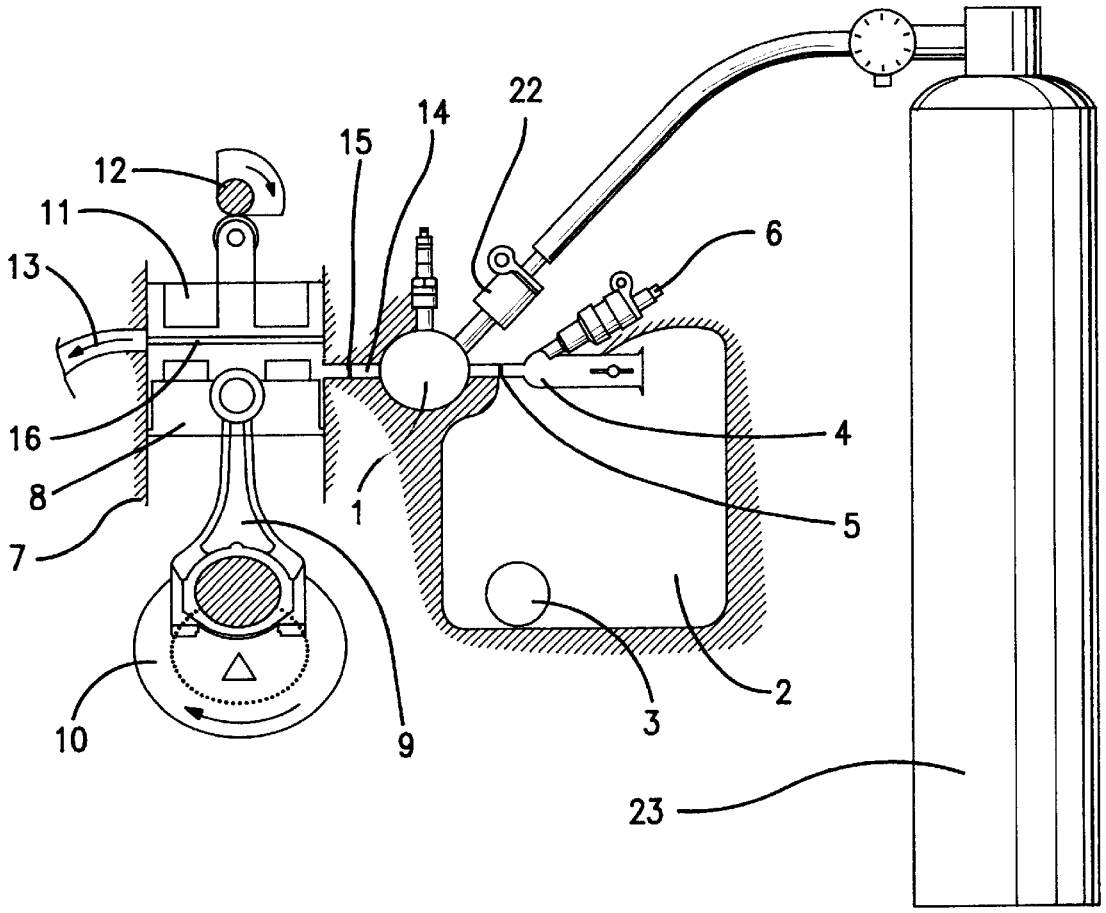
FIG. 1 depicts, viewed in cross section, one embodiment of the invention applied to an internal combustion engine with a constant-volume independent combustion chamber with the main piston at top dead center at the end of the exhaust stroke.
Figure 2:
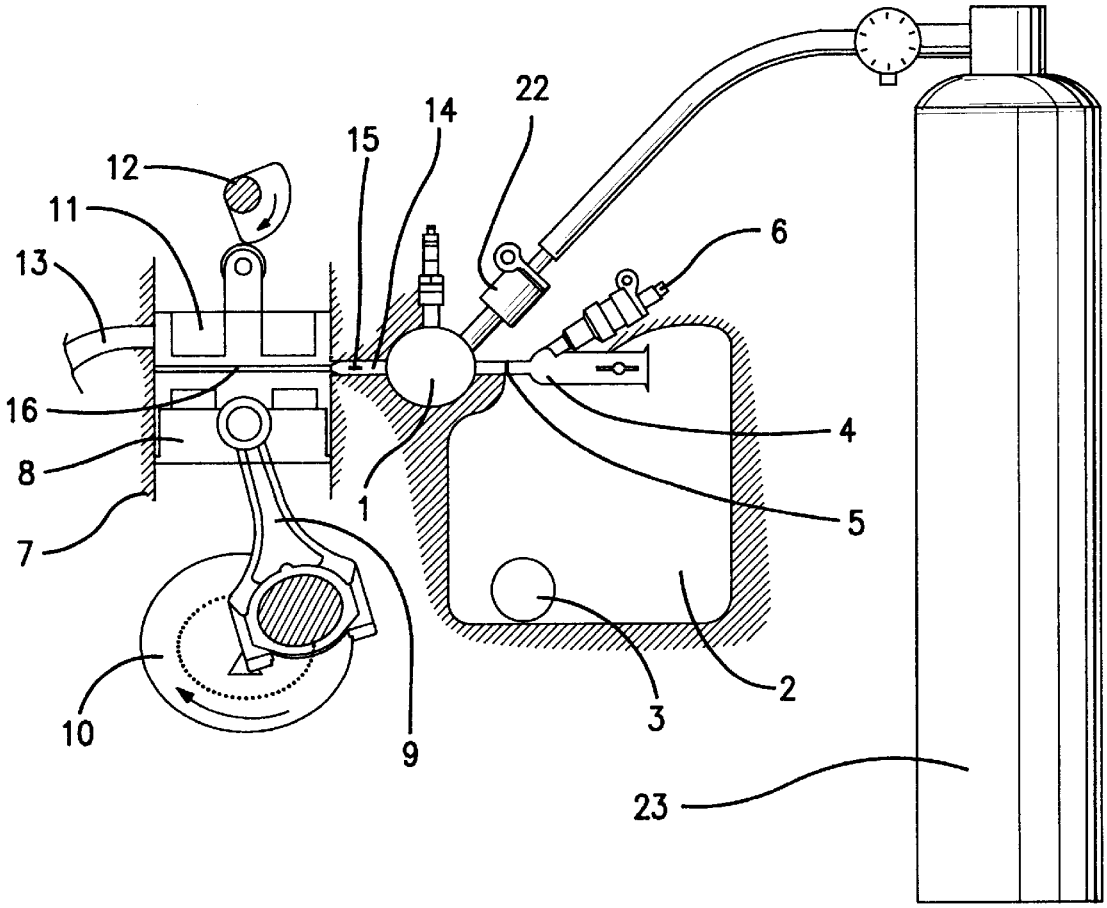
FIG. 2 depicts this same engine at the beginning of the expansion stroke.

FIGS. 1 and 2 depict an embodiment of the method according to the invention, applied to a cyclic internal combustion engine with a constant-volume independent combustion chamber where the combustion chamber 1 is fed from a buffer volume 2 of compressed air kept at a more or less constant pressure, this volume itself being fed from a compressor through a pipe 3. A pipe 4, the opening and closing of which are controlled by a flap 5, connects the buffer volume 2 to the independent combustion chamber 1 and contains a fuel injector 6 intended to produce the air/fuel mixture substantially before this mixture is introduced into the combustion chamber 1 where it will be ignited.

An expansion cylinder 7 is equipped with a main piston 8 connected by a connecting rod 9 to the wrist pin of a crankshaft 10, and with an opposed secondary piston 11, the motion of which here is controlled by a cam 12—itself driven off the crankshaft 10—in such a way that it will accompany the main piston 8 over part of its downstroke so as to make the start-of-expansion pressure—as soon as the flap 15 opens the duct 14 which connects the combustion chamber to the expansion chamber 16—in a minimum volume, coincide with a crank angle and connecting rod angle of inclination which give the optimum expansion mean tangential force.

An injector 22 of additional compressed air, according to the invention, is fitted in the combustion chamber 1 and is fed, through a pressure-reducing valve, from a bottle 23 that stores compressed air (or any other compatible gas) at high pressure.

During low-power running, according to the invention, when the engine is at top dead center in the expansion cylinder (FIG. 1), the combustion chamber 1 has just been isolated and contains a mass of pure, fuel-free, hot, compressed air the fuel injector 6 will not be operated. The additional-air injector 22 is open and introduces into the combustion chamber a small amount by mass of additional air at ambient temperature coming from the high-pressure storage bottle 23 and expanded to a pressure slightly higher than the pressure in the combustion chamber, so as to allow transfer; this mass of additional air will heat up when it comes into contact with the compressed air contained in the combustion chamber, will expand and will substantially increase the initial pressure so as to produce a power stroke by expanding in the expansion chamber once the duct 14 opens (FIG. 2). On account of the excellent efficiency of the engine unit depicted, the amount of additional air will be very small and will determine the amount of power produced.

The means of injecting additional air into the combustion chamber can vary without altering the principle of the invention, but an electromechanical injector like the fuel injectors is preferred, as it will be possible to control it more readily, particularly as regards its flow rate, using the onboard electronics.

Figure 3:
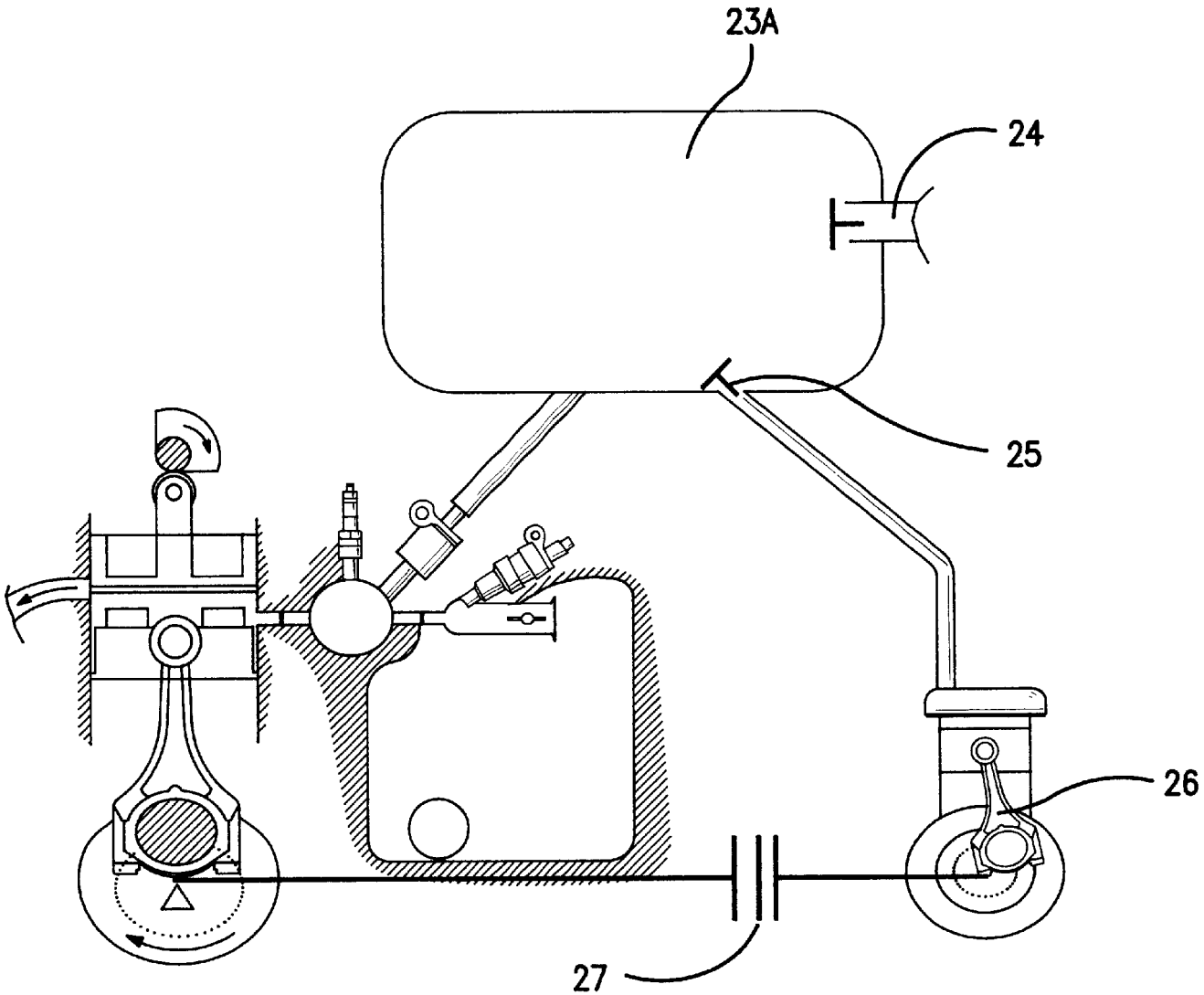
FIG. 3 depicts a functional drawing of an installation in a vehicle.

FIG. 3 depicts a functional diagram of an installation of the method according to the invention in a vehicle, where the reservoir for storing compressed additional air at high pressure 23A is equipped on the one hand with a filler orifice 24 for filling "at the pump" and also with an auxiliary filler orifice 25 fed by a small on-board high-pressure compressor 26 which will be set in operation by a clutch system 27 during deceleration and braking, thus giving the vehicle excellent engine braking, and also when running on the highway at high power. The advantage of this arrangement is that it considerably increases the range in eliminated-pollution running.

It goes without saying that the design of the reservoir, of the air injector, of the high-pressure compressor, of its clutch, of the filler valves and other non-return valves, can vary without in any way altering the principle of the invention which is not in any way restricted to the embodiments described and depicted and can be varied in many ways within the competence of those skilled in the art to suit the considered applications without in any way departing from its spirit.

We claim:

1. Apparatus for reducing pollution of a cyclic internal combustion engine, comprising:

a constant volume independent combustion chamber fluidly connected to a buffer volume of compressed air via a pipe, said buffer volume being fluidly connected to a compressor;

a first flap positioned in said pipe for controlling the opening and closing thereof;

a fuel injector structured and arranged to produce an air/fuel mixture before introducing said mixture into the combustion chamber;

an expansion chamber equipped with a main piston connected to a crank shaft, and with a secondary piston mounted in opposition;

said expansion chamber being fluidly connected to the combustion chamber via a duct having a second flap positioned in said duct;

the movement of said secondary piston being controlled to accompany the main piston over part of its downstroke so as to make the start of expansion pressure, in a minimum volume, coincide with a crank angle and connecting rod angle of inclination, which produce an optimum expansion mean tangential force; and an air injector fluidly connected to the combustion chamber and to a source of highly pressurized compressed air;

means for actuating said air injector during low power operation, when operation of said fuel injector is discontinued, and after a charge of hot compressed air contained in the buffer volume has been admitted into the combustion chamber, whereby actuation of said air injector lets a small amount of compressed air contact said hot air, expand, and increase in pressure to produce a power stroke.

2. Apparatus according to claim 1, wherein the source of highly pressurized compressed air comprises a reservoir having a filler orifice with a non-return valve.

3. Apparatus according to claim 1, wherein the source of highly pressurized compressed air comprises a storage reservoir having an auxiliary filler orifice fed by a high pressure on-board compressor structured and arranged to be set in operation by a clutch during deceleration or braking of the vehicle.

4. Method for reducing pollution of a cyclic internal combustion engine, comprising:

providing a constant volume independent combustion chamber fluidly connected to a buffer volume of compressed air via a pipe, said buffer volume being fluidly connected to a compressor;

controlling the opening and closing of said pipe by providing a first flap positioned in said pipe;

providing a fuel injector structured and arranged to produce an air/fuel mixture;

introducing said mixture into the combustion chamber;

providing an expansion chamber equipped with a main piston connected to a crank shaft, and with a secondary piston mounted in opposition; said expansion chamber being fluidly connected to the combustion chamber via a duct;

controlling movement of said secondary piston to accompany the main piston over part of its downstroke so as to make the start of expansion pressure, in a minimum volume, coincide with a crank angle and connecting rod angle of inclination which produce an optimum expansion mean tangential force;

providing an air injector fluidly connected to the combustion chamber and to a source of highly pressurized compressed air;

actuating said air injector during low power operation, when operation of said fuel injector is discontinued, and after a charge of hot compressed air contained in the buffer volume has been admitted into the combustion chamber, to let a small amount of compressed air contact said hot air, expand and increase in pressure to produce a power stroke.

5. The method according to claim 4, wherein the engine is fitted with an auxiliary high-pressure compressor which will be switched on as the vehicle slows down or brakes, as well as during running at high power when the fuel injector is operated, thereby making it possible to improve the range in a limited-pollution running.

* * * * *